US008476966B2

(12) United States Patent
Buechner et al.

(10) Patent No.: US 8,476,966 B2
(45) Date of Patent: Jul. 2, 2013

(54) ON-DIE VOLTAGE REGULATION USING P-FET HEADER DEVICES WITH A FEEDBACK CONTROL LOOP

(75) Inventors: Thomas Buechner, Weil im Schoenbuch (DE); Sebastian Ehrenreich, Schoenau (DE); Tilman Gloekler, Gaertringen (DE); Bruno U. Spruth, Dettenhausen (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/181,848

(22) Filed: Jul. 13, 2011

(65) Prior Publication Data

US 2012/0081176 A1 Apr. 5, 2012

(30) Foreign Application Priority Data

Oct. 5, 2010 (EP) ..... 10186599

(51) Int. Cl.
*G05F 1/10* (2006.01)

(52) U.S. Cl.
USPC ..... 327/541

(58) Field of Classification Search
USPC ..... 327/541
See application file for complete search history.

(56) References Cited

U.S. PATENT DOCUMENTS

| | | | | |
|---|---|---|---|---|
| 4,488,144 | A * | 12/1984 | Wollman | 341/118 |
| 4,827,205 | A | 5/1989 | Hafner, Jr. et al. | |
| 5,162,668 | A | 11/1992 | Chen et al. | |
| 5,721,485 | A | 2/1998 | Hsu et al. | |
| 5,907,299 | A * | 5/1999 | Green et al. | 341/143 |
| 6,614,706 | B2 * | 9/2003 | Feurle | 365/226 |
| 7,218,168 | B1 * | 5/2007 | Rahman | 327/540 |
| 7,400,123 | B1 * | 7/2008 | Voogel | 323/280 |
| 7,447,924 | B2 * | 11/2008 | May | 713/300 |
| 7,557,550 | B2 * | 7/2009 | Mellachurvu et al. | 323/281 |
| 7,573,322 | B2 * | 8/2009 | Gatta et al. | 327/538 |
| 8,159,201 | B2 * | 4/2012 | Lin et al. | 323/273 |
| 8,253,481 | B2 * | 8/2012 | Sasaki et al. | 327/544 |
| 8,258,860 | B2 * | 9/2012 | Dathe et al. | 327/544 |
| 2006/0103453 | A1 * | 5/2006 | Pisasale et al. | 327/541 |
| 2008/0036530 | A1 * | 2/2008 | Chang | 327/538 |

OTHER PUBLICATIONS

Gjanci, Juliana, "On-Chip Voltage Regulation for Power Management in System-on-Chip", Thesis for the degree of Master of Science in Electrical and Computer Engineering, University of Illinois at Chicago, 2008, pp. 1-47.

(Continued)

*Primary Examiner* — Thomas J Hiltunen
(74) *Attorney, Agent, or Firm* — Francis Lammes; Stephen J. Walder, Jr.; Libby Z. Toub

(57) ABSTRACT

The invention relates to a voltage regulator circuit for providing voltage to an integrated circuit chip, comprising a reference voltage generator providing a reference voltage, a pFET header device having a plurality of pFET fingers, wherein each pFET finger in the plurality of pFET fingers is adapted for providing a different pFET output voltage to the integrated circuit chip, and a pFET control device for switching the plurality of pFET fingers depending on a comparison between the reference voltage and the pFET output voltage. The voltage regulator circuit allows for dynamically switching on or off the pFET fingers based on the output of the comparison of the reference voltage and the pFET output voltage, and thus allows for dynamically switching on or off, respectively, at least partly the integrated circuit chip.

19 Claims, 1 Drawing Sheet

OTHER PUBLICATIONS

Gjanci, Juliana, "On-Chip Voltage Regulation for Power Management in System-on-Chip", Thesis for the degree of Master of Science in Electrical and Computer Engineering, University of Illinois at Chicago, 2008, pp. 48-89.

Kim, Wonyoung et al., "Enabling On-Chip Switching Regulators for Multi-Core Processors using Current Staggering", http://citeseerx.ist.psu.edu/viewdoc/download?doi=10.1.1.128.9864&rep=rep1&type=pdf, in Proceedings of the Work on Architectural Support for Gigascale Integration, 2007, 11 pages.

Kuang, J. B. et al., "A Low-Overhead Virtual Rail Technique for SRAM Leakage Power Reduction", 2005 International Conference on Computer Design, San Jose California, Oct. 2005, 6 pages.

Onizuka, Kohei et al., "VDD-Hopping Accelerators for On-Chip Power Supply Circuit to Achieve Nan-Second Order Transient Time", http://lowpower.iis.u-tokyo.ac.jp/SPN/2006/20060671.pdf, printed Jul. 12, 2011, 28 pages.

* cited by examiner

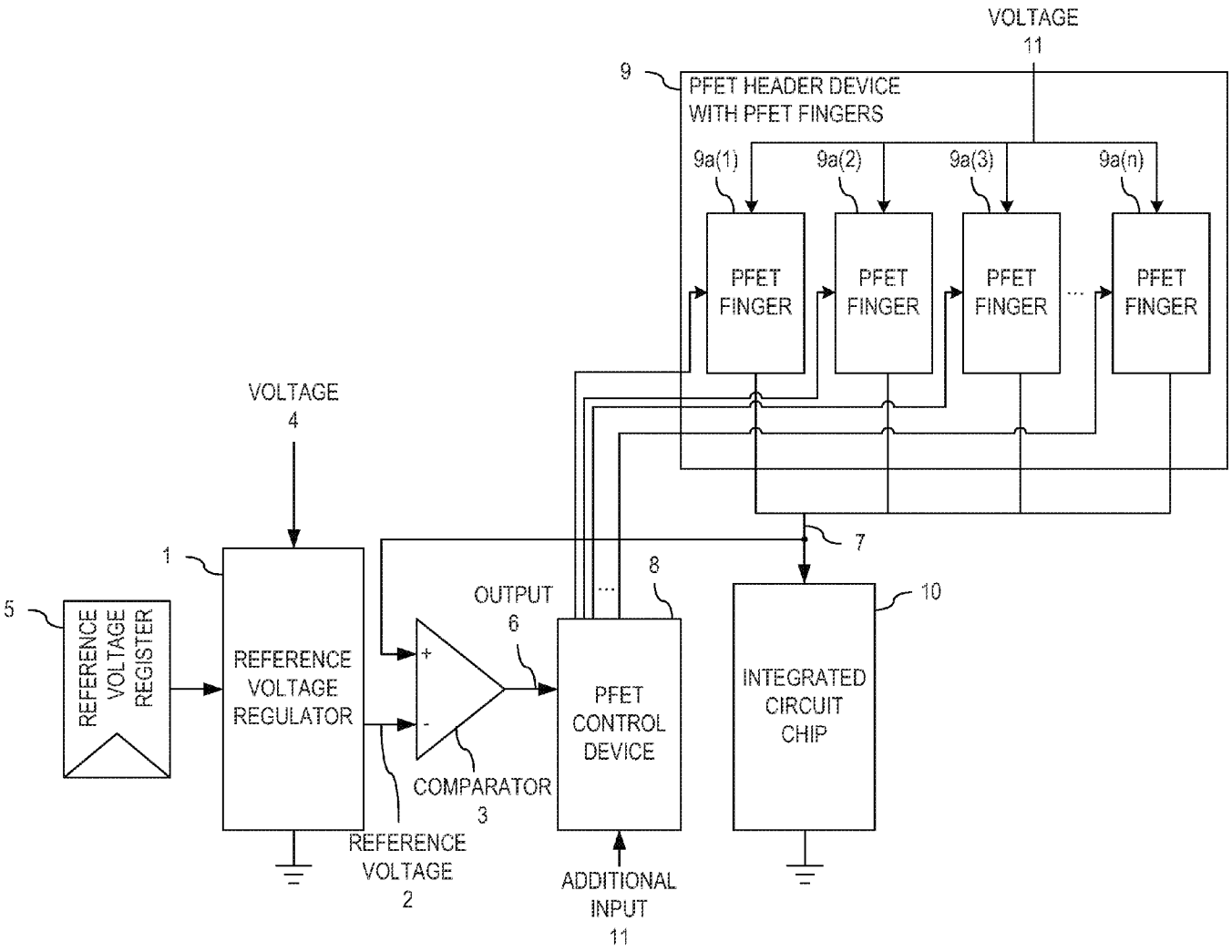
VOLTAGE
11
PFET HEADER DEVICE
WITH PFET FINGERS
9
9a(1)
9a(2)
9a(3)
9a(n)
PFET
FINGER
PFET
FINGER
PFET
FINGER
PFET
FINGER
7
10
INTEGRATED
CIRCUIT
CHIP
8
PFET
CONTROL
DEVICE
ADDITIONAL
INPUT
11
OUTPUT
6
COMPARATOR
3
+
-
REFERENCE
VOLTAGE
2
VOLTAGE
4
REFERENCE
VOLTAGE
REGULATOR
1
REFERENCE
VOLTAGE
REGISTER
5

ON-DIE VOLTAGE REGULATION USING P-FET HEADER DEVICES WITH A FEEDBACK CONTROL LOOP

BACKGROUND

The present invention relates to a voltage regulator circuit for providing voltage to an integrated circuit chip and to a method for regulating a voltage of an integrated circuit chip.

Voltage regulators, also called voltage downconverters, have become quite popular in todays integrated circuit chips, e.g. in memory, microprocessor and microcontroller areas. In particular, a chip with an on-chip voltage regulator can be operated with a single external power supply. Moreover, more than one level of internal power supply voltage can be generated for different applications in different operating modes. Using a lower power supply voltage reduces consumption by the circuit. Moreover, a voltage regulator regulates the supply voltage such that it becomes relatively insensitive to external power variations.

Beside a general demand for higher computational capabilities, low-power operation has become equally, if not more, important in recent years. Techniques, such as power gating, have become available for temporarily turning off selective circuit blocks that are not used in order to reduce overall leakage power of the chip. Such temporary shutdown time is called, for example, in the prior art "low power mode" or "inactive mode". When the circuit blocks are required again for operation, they are activated to "active mode". For maximizing power performance while minimizing impact to performance, these two modes are switched at an appropriate time and in a suitable manner.

Basically, prior art teaches two different regulator topologies for switching the voltage of a chip. Linear regulators operate using e.g. a transistor acting as a pass resistor in order to establish a fixed voltage at the output. Switching regulators are often mixed-mode circuits that feed back an analogue error signal and digitally gate it to provide bursts of current at the output.

However, linear regulators possess poor efficiencies in some operating modes, e.g. when the output voltages is much lower than the input voltage. Switching regulators exhibit some serious concerns when it comes to on-chip implementation, as they often require a large size of inductors and capacitors. Other drawbacks of voltage regulators known from prior art are, e.g., bald voltage stability when the current draw changes, suboptimum temperature stability and no compensation for silicon aging.

SUMMARY

It is therefore an object of the invention to provide a voltage regulation for an integrated circuit chip that allows for an improved operation of the integrated circuit chip.

This object is achieved by the independent claims. Advantageous embodiments are detailed in the dependent claims.

Accordingly, this object is achieved by a voltage regulator circuit for providing voltage to an integrated circuit chip, comprising a reference voltage generator providing a reference voltage, a pFET header device having a plurality of pFET fingers, where each pFET finger in the plurality of pFET fingers is adapted for providing a different pFET output voltage to the integrated circuit chip, and a pFET control device for switching the plurality of pFET fingers depending on a comparison between the reference voltage and the pFET output voltage.

The object of the invention if further addressed by a method for regulating a voltage of an integrated circuit chip, comprising a pFET header device having a plurality of pFET fingers, where each pFET finger in the plurality of PFET fingers is adapted for providing a pFET output voltage to the integrated circuit chip, and comprising the step of: comparing a reference voltage and the pFET output voltage, and switching the pFET fingers depending on the comparison.

Further embodiments and advantages of the method according to the invention are derivable for one of ordinary skill in the art from the description above of the voltage regulator circuit according to the invention.

BRIEF DESCRIPTION OF THE SEVERAL VIEWS OF THE DRAWINGS

A preferred embodiment of the invention is illustrated in the accompanied figure. The embodiment is merely exemplary, i.e. the embodiment is not intended to limit the content and scope of the appended claims.

FIG. 1 shows a circuit diagram of a voltage regulator circuit according to a preferred embodiment of the invention.

DETAILED DESCRIPTION

Referring now to FIG. 1, a circuit diagram of a voltage regulator circuit according to a preferred embodiment of the invention is shown.

The voltage regulator circuit comprises a reference voltage generator 1 providing a reference voltage 2, e.g. 0.6-0.7 V, to a comparator 3. The reference voltage generator 1 comprises an R-2R network, not shown, for providing the reference voltage 2. The reference voltage generator 1 is fed by a voltage 4 of e.g. 1.1-1.2 V. Furthermore, a reference voltage register 5 for adjusting the reference voltage 2 to be provided by the reference voltage generator 1 is shown.

The comparator 3 comprises an operational amplifier having an inverting input, a non-inverting input and an output 6, the inverting input is connected to the reference voltage generator 1, the non-inverting input is connected to a pFET output voltage 7 provided by a pFET header device and the output is connected to a pFET control device 8.

The pFET header device 9 comprises a plurality of pFET fingers 9*a*, e.g. 16 pFET fingers 9*a*(a)-9*a*(n), that are each switchable by the pFET control device 8. The pFET output voltage 7 is also provided to an integrated circuit chip 10, such as a microprocessor. The pFET fingers 9*a*, are fed by a voltage 11 of e.g. 1.1-1.2 V.

The pFET control device 8 comprises a sigma-delta converter or a sigma-delta like converter for switching the pFET fingers 9*a* based on a comparison of the reference voltage 2 and pFET output voltage 7. An additional pFET finger 9*a* is switched on if the pFET output voltage 7 is lower than the reference voltage 2 and an additional pFET finger 9*a* is switched off if the pFET output voltage 7 is greater than the reference voltage 2.

Such way, each pFET finger 9*a* is adapted for providing the pFET output voltage 7 to a block of the integrated circuit chip 10 so that the respective block of the integrated circuit chip 10 can be switched off into an "inactive" retention mode or switched on into an "active" mode. While it is either way possible, it is mostly preferred that the voltage regulator circuit is provided as an on-chip voltage regulator circuit.

Accordingly, the illustrative embodiments provide a voltage regulator circuit for providing voltage to an integrated circuit chip, that comprises a reference voltage generator providing a reference voltage, a pFET header device having a plurality of pFET fingers, where each pFET finger is adapted for providing a different pFET output voltage to the integrated circuit chip, and a pFET control device for switching the plurality of pFET fingers depending on a comparison between the reference voltage and the pFET output voltage.

Accordingly, it is an essential idea of the invention to switch the pFET fingers, e.g. a single OTT finger at a time, depending on the comparison of the reference voltage and the pFET output voltage, i.e. to switch the pFET fingers in a digital manner depending on the feedback received from the comparison of the reference voltage and the pFET output voltage. Contrary to prior art, wherein the gate input of the pFET was changed in a linear way to adjust the pFET output voltage, the illustrative embodiments discloses to switch, e.g. to switch on or off, the pFET fingers preferably individually, such wise enabling more or less pFET fingers, respectively, to provide the pFET output voltage to the integrated circuit chip. In other words, the voltage regulator according to the invention allows for dynamically switching, or changing, the pFET fingers based on the output of the comparison of the reference voltage and the pFET output voltage, thus for dynamically adjusting the voltage provided to the integrated circuit chip. Therefore, the solution according to the invention provides for a very simple and power efficient operation of the integrated circuit chip, allowing the integrated circuit chip to change at least partly into a so called retention mode. Switching the pFET fingers in such a digital manner has the further advantage that overall testing of the voltage regulator becomes easier, as it is generally easier to test digital equipment than analogue equipment.

The pFET header device may comprise any pFET header device known from prior art. Preferably, the pFET header device comprises 2, 16, 30 or any other number of pFET fingers which are each connected to the integrated circuit chip. It is further preferred that an output of the pFET control device is connected to a gate of the pFET header device, the pFET output voltage is connected to a drain of the pFET header device, and that a voltage source, such as an external voltage source, is connected to a source of the pFET header device. In this way, the pFET control device preferably sends a control signal for switching the pFET finger. For one of ordinary skill in the art is also equally possible to use an nFET header device, having an nFET finger and an nFET output voltage, respectively.

In another preferred embodiment of the invention, the pFET control device is adapted for switching on one of the plurality of pFET fingers if the pFET output voltage is lower than the reference voltage and for switching off a different one of the plurality of pFET fingers if the pFET output voltage is greater than the reference voltage. In other words it is preferred that a pFET finger is activated if the pFET output voltage is too low, i.e. a pFET finger is switched on, and that a pFET finger is deactivated if the pFET output voltage is to high, i.e. a pFET finger is switched on. In such way it is further (preferred that the pFET fingers are "digitally" switched on or off, respectively, which results in that the respective pFET output voltage provided by the pFET finger switches the integrated circuit chip on or off, respectively, e.g. switches on or off, respectively, a block of the integrated circuit chip. The embodiment allows therefore to easily switch on or off, respectively, a block of the integrated circuit chip, e.g. allows the switched off block of the integrated circuit chip to change into a retention mode.

In this manner it is according to another embodiment of the invention furthermore preferred, that the pFET control device is adapted for switching on or off, respectively, an additional one of the plurality of pFET fingers. This means that, for example, the pFET control device activates an additional pFET finger if the pFET output voltage is lower than the reference voltage.

Generally, the pFET control device may comprise any means known from prior art such as a state machine for switching the plurality of pFET fingers depending on an input signal. However, according to another preferred embodiment of the invention, the pFET control device comprises a sigma-delta converter for switching the plurality of pFET fingers. It is furthermore preferred that the pFET control device comprises a sigma-delta like converter. Such way, the pFET control device receives an input signal from the comparison of the reference voltage and the pFET output voltage, e.g. a "0" or a "1" input signal, and switches the pFET fingers based on this input signal, e.g. switches on an additional pFET finger if the input signal is "0" or switches off an additional pFET finger if the input signal is "1".

In another preferred embodiment, the pFET control device 8 comprises an additional input 11 and the pFET control device is adapted for switching on one or more of the plurality of pFET fingers if the additional input is greater than zero. Having such additional input is advantageous as it directly allows switching on additional pFET fingers independently from the comparison of the reference voltage and the pFET output voltage. With such means further blocks of the integrated circuit chip can be directly "activated", e.g. for directly leaving the retention mode of the integrated circuit chip.

Generally, the voltage regulator may comprise any means known from the prior art for comparing the reference voltage and the pFET output voltage, such as, for example, a regular clocked sense amplifier. However, according to a preferred embodiment of the invention, the voltage regulator circuit comprises a comparator for comparing the reference voltage and the pFET output voltage. Preferably, the comparator is provided as a voltage comparator. According to a further advantageous embodiment of the invention, the comparator comprises an operational amplifier having an inverting input, a non-inverting input and an output, the inverting input is connected to the reference voltage generator, the non-inverting input is connected to the OFT output voltage and the output is connected to the pFET control device.

In another preferred embodiment, each pFET finger is adapted for providing the pFET output voltage to a block of the integrated circuit chip. With such means, Hocks of the integrated circuit chip can be turned off, e.g. temporarily turned off, to reduce overall leakage power of the integrated circuit chip.

It is especially preferred that the integrated circuit chip comprises a microprocessor. In another embodiment, the integrated circuit chip comprises a microcontroller or a memory, such as, for example, a DRAM or a SDRAM.

Generally, the reference voltage generator may comprise any voltage generator means known from prior art. However, it is especially preferred that the reference voltage generator comprises an R-2R network for providing the reference voltage. An R-2R network allows for a very simple and cheap realization of a reference voltage generator. In a further embodiment, the voltage regulator circuit comprises a reference voltage register for adjusting the voltage to be provided by the reference voltage generator.

The voltage regulator circuit according to the invention can be provided off-chip, i.e. on a different chip than the integrated circuit chip. However, according to a further embodiment of the invention it is especially preferred that the voltage regulator circuit is provided as an on-chip voltage regulator circuit. As the voltage regulator circuit according to the invention does only require a very little number of circuit logic, such as, e.g., the pFET control device and the comparator, providing the voltage regulator circuit at least partially or completely on-chip will only require a very small additional silicon area and, thus, such embodiment will be very easy and cheap to manufacture.

While the invention has been illustrated and described in detail in the drawings and fore-going description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A voltage regulator circuit for providing voltage to an integrated circuit chip, the voltage regulator circuit comprising:

a reference voltage generator providing a reference voltage, a pFET header device having a plurality of pFET fingers, wherein each pFET finger in the plurality of pFET fingers is adapted for providing a different pFET output voltage to the integrated circuit chip, and a pFET control device for switching the plurality of pFET fingers depending on a comparison between the reference voltage and the pFET output voltage, wherein the pFET control device comprises an additional input and wherein the pFET control device is adapted for switching on one or more of the plurality of pFET fingers if the additional input is greater than zero.

2. The voltage regulator circuit of claim 1, wherein the pFET control device is adapted for switching on one of the plurality of pFET fingers if the pFET output voltage is lower than the reference voltage and for switching off a different one of the plurality of pFET fingers if the pFET output voltage is greater than the reference voltage.

3. The voltage regulator circuit of claim 2, wherein the pFET control device is adapted for switching on or off, respectively', an additional one of the plurality of pFET fingers.

4. The voltage regulator circuit of claim 1, wherein the pFET control device comprises a sigma-delta converter for switching the plurality of pFET fingers.

5. The voltage regulator circuit of claim 1, further comprising:

a comparator for comparing the reference voltage and the pFET output voltage.

6. The voltage regulator circuit of claim 5, wherein the comparator comprises an operational amplifier having an inverting input, a non-inverting input and an output, and wherein the inverting input is connected to the reference voltage generator, the non-inverting input is connected to the pFET output voltage and the output is connected to the pFET control device.

7. The voltage regulator circuit of claim 1, wherein each pFET finger in the plurality of pFET fingers is adapted for providing the pFET output voltage to a block of the integrated circuit chip.

8. The voltage regulator circuit of claim 1, wherein the integrated circuit chip comprises a microprocessor.

9. The voltage regulator circuit of claim 1, wherein the reference voltage generator comprises an R-2R network for providing the reference voltage.

10. The voltage regulator circuit of claim 1, wherein the voltage regulator circuit is provided as an on-chip voltage regulator circuit.

11. A method for regulating a voltage of an integrated circuit chip, the method comprising:

a pFET header device having a plurality of pFET fingers, wherein each pFET finger in the plurality of pFET fingers is adapted for providing a different pFET output voltage to the integrated circuit chip, and comprising the step of:

comparing a reference voltage and the pFET output voltage, and switching the pFET fingers depending on the comparison, wherein one of more of the plurality of pFET fingers is switched on if an additional input is greater than zero.

12. The method of claim 11, wherein switching the plurality of pFET fingers comprises switching on one of the plurality of pFET fingers if the pFET output voltage is lower than the reference voltage and switching off a different one of the plurality of pFET fingers if the pFET output voltage is greater than the reference voltage.

13. The method of claim 12, wherein switching on or off one of the plurality of pFET fingers, respectively, comprises switching on or off, respectively, an additional one of the plurality of pFET fingers.

14. The method of claim 11, wherein the switching of the pFET fingers depending on the comparison is performed by a pFET control device and wherein the pFET control device comprises a sigma-delta converter for switching the plurality of pFET fingers.

15. The method of claim 11, wherein the comparing of the reference voltage and the pFET output voltage is performed by a comparator, wherein the comparator comprises an operational amplifier having an inverting input, a non-inverting input and an output, and wherein the inverting input is connected to the reference voltage generator, the non-inverting input is connected to the pFET output voltage and the output is connected to the pFET control device.

16. The method of claim 11, wherein each pFET finger in the plurality of pFET fingers is adapted for providing the pFET output voltage to a block of the integrated circuit chip.

17. The hod of claim 11, wherein integrated circuit chip comprises a microprocessor.

18. The method of claim 11, wherein the reference voltage is provided by a reference voltage generator and wherein the reference voltage generator comprises an R-2R network for providing the reference voltage.

19. The method of claim 11, wherein the voltage regulator circuit is provided as an on-chip voltage regulator circuit.

* * * * *